United States Patent [19]

Thomas

[11] Patent Number: 4,556,771

[45] Date of Patent: Dec. 3, 1985

[54] MICROWAVE FEED FOR COMMON CAVITY OVEN

[75] Inventor: Calvin J. Thomas, Orefield, Pa.

[73] Assignee: Raytheon Company, Lexington, Mass.

[21] Appl. No.: 632,353

[22] Filed: Jul. 19, 1984

[51] Int. Cl.[4] ..... H05B 6/72

[52] U.S. Cl. ..... 219/10.55 F; 219/10.55 R; 219/10.55 E

[58] Field of Search ..... 219/10.55 F, 10.55 E, 219/10.55 A, 10.55 R, 10.55 D

[56] References Cited

U.S. PATENT DOCUMENTS

| | | | |
|---|---|---|---|
| 2,961,520 | 11/1960 | Long | 219/10.55 F |
| 3,511,958 | 5/1970 | Staats | 219/10.55 F |
| 3,936,627 | 2/1976 | Fitzmayer | 219/10.55 F |
| 4,053,730 | 10/1977 | Baron et al. | 219/10.55 F |
| 4,105,886 | 8/1978 | Baron et al. | 219/10.55 E |
| 4,303,817 | 12/1981 | Klement et al. | 219/10.55 D |
| 4,316,069 | 2/1982 | Fitzmayer | 219/10.55 F |

*Primary Examiner*—Philip H. Leung

*Attorney, Agent, or Firm*—William R. Clark

[57] ABSTRACT

A back fed common cavity microwave and electric oven having a radiating antenna positioned in a back wall recess substantially separated from the rest of the cavity by a high temperature microwave transparent cover. The antenna is a linear finger approximately half a wavelength long and rotates about one end in the recess which is approximately 6 inches square with a depth of approximately 0.8 inches. The antenna is energized by a rod which extends through an aperture in the recess to a waveguide positioned therebehind.

11 Claims, 8 Drawing Figures

MICROWAVE FEED FOR COMMON CAVITY OVEN

BACKGROUND OF THE INVENTION

The general field of the invention relates to microwave feed apparatus for a common cavity microwave and electric self-clean oven. More particularly, the invention relates to a backfed common cavity microwave and electric oven.

Heating uniformity has been a primary consideration throughout the development of microwave ovens. In first generation microwave ovens, the microwave energy was either excited in the cavity by the direct insertion of the magnetron probe or the microwave energy was coupled to a waveguide that communicated with the cavity. In either case, complex standing waves were set up in the cavity causing "hot" spots. To improve heating uniformity, mode stirrers or moving metal parts were introduced into the cavity so that the complex standing wave patterns and hence hot spots moved.

Later, radiating antennas or primary radiators were introduced and their objective was to provide a directive uniform radiated pattern so that a larger percentage of the microwave energy would be transmitted directly to the food rather than reflecting off the walls where standing waves and hot spots could be set up. It was recognized that the heating uniformity of primary radiators could be enhanced by rotating them. Still another technique for improving heating uniformity was the introduction of a turntable that moved the food relative to the microwave radiated pattern.

The heating uniformity within a food body is also a function of the geometry of the food body. For example, one common food body geometry is horizontally large but vertically short such as a snacking cake or a casserole in a low, flat dish. For this common geometry, it has generally been felt that it is necessary to feed the microwave energy into the cavity from either the top or bottom, and this is especially true when a directive radiating antenna is used. Accordingly, the microwave energy entering either the top or bottom large surface is relatively uniform so that the entire body heats at approximately the same rate. It has also been felt and demonstrated that if the microwave energy were directed at such a geometry from the side, the depth of penetration would generally be such that the side facing the source would absorb most of the available microwave energy thereby heating it rapidly while the opposite side remained relatively cool or underdone.

As a result of the above, microwave ovens including common cavity microwave and electric ovens with directive antennas have generally been fed from either the top or bottom of the cavity. The top mounting has the disadvantage that the temperature of the microwave components becomes quite hot during self-cleaning. The bottom feed has the disadvantage in that provisions generally must be taken to prevent oven spills from running into an open waveguide. Further, with a common cavity wall oven, there is physically very little room for the microwave apparatus at the top and bottom of the cavity.

SUMMARY OF THE INVENTION

It is therefore a general object of the invention to provide a microwave oven that is fed from other than the top or bottom and provides uniform heating.

It is another object to provide a backfed common cavity wall oven.

Further, it is an object of the invention to provide a wall oven wherein the microwave energy is fed from the back so that the top and bottom are physically unencumbered by microwave apparatus permitting the insertion into a wall. It is an object of the invention that such an oven provides uniform heating within a wide variety of food bodies including those having a relatively low profile. Also, it is an object that the magnetron of such an oven be optimally coupled to the cavity for providing maximum power such as, for example, approximately 700 watts.

The invention defines a back fed microwave oven comprising a microwave conductive cavity having a back wall with a recess with an aperture, a microwave transparent cover substantially separating the recess from the remainder of the cavity, a waveguide positioned behind the back wall and communicating with the recess through the aperture, a magnetron for energizing the waveguide, a horizontal rod for coupling the microwave energy through the aperture into the recess, a radiating antenna connected to the rod for radiating microwave through the cover into the remainder of the cavity, means for rotating the rod to rotate the radiating antenna, and the recess having a depth substantially less than a half wavelength of said microwave energy and having side walls configured so that as the radiating antenna rotates, the distance between the antenna and the walls varies. For example, the radiating antenna may be linear and be mounted perpendicular to the rod wherein the outer path of the antenna defines a circle as it rotates and the recess defines a rectangular box. Accordingly, the spacing between the circle and the side walls of the rectangular box vary as a result of rotation. Further, it may be preferable that the oven include an electric heating element positioned in the remainder of the cavity to provide thermal energy for cooking and self-cleaning. The cover may preferably be Pyroceram. Also, it may be desirable that the box have a depth of approximately 0.8 inches and the radiating antenna be spaced approximately 0.3 inches from the cover. The box may preferably have an entrance approximately 6 inches square.

The invention may also be practiced by a back fed common cavity microwave and electric oven, comprising a microwave conductive cavity formed by side walls, a ceiling, a floor, a door, and a back wall having a recess defined by an outwardly extending box having a depth substantially less than half a wavelength of the microwave energy, a horizontal microwave transparent planar cover substantially separating the recess from the remainder of the cavity, an electric heating element positioned in the remainder of the cavity for providing thermal energy for cooking and self-cleaning, a radiating element positioned in the recess substantially parallel with the cover and spaced less than 0.5 inches therefrom, means for exciting the antenna with microwave energy, and means for rotating the antenna in a vertical plane. It may be preferable that the radiating element be a flat linear finger having a length approximately a half wavelength long and rotated about one end.

The invention further defines a combination microwave and electric self-cleaning oven comprising an oven cavity defined by side walls, a back wall, a floor, a ceiling, and a door, the back wall having a recess with a substantially rectangular entrance approximately 6 inches square and a depth of less than one inch, a high temperature microwave transparent flat cover substantially separating the recess from the remainder of the cavity, a waveguide positioned behind the back wall and communicating with the recess through an aperture in the recess, a magnetron positioned above the cavity for energizing the waveguide with microwave energy, a radiating antenna having a length less than 3 inches, the antenna being spaced less than one half inch from the cover in the recess, means for rotating the antenna in a plane parallel with the cover, means for coupling microwave energy from the waveguide through the aperture to the radiating antenna, and an electric heating element positioned in the cavity for providing thermal energy for cooking and for self-cleaning. Further, it may be preferable that the sum of the effective electrical lengths of the depth of the recess and the cover be approximately one quarter wavelength of said microwave energy in free space.

The invention may also be practiced by a combination microwave and electric self-cleaning wall oven comprising an oven cavity defined by side walls, a back wall, a floor, a ceiling, and a door, the back wall having a recess with a substantially rectangular entrance approximately 6 inches square with a depth of less than one inch, a waveguide positioned behind the back wall and having one end communicating with the recess through an aperture, the waveguide extending vertically upward and terminating above the ceiling, a magnetron positioned above the ceiling and being coupled to the waveguide for providing microwave energy thereto, a radiating element having a length of approximately one half wavelength being positioned in the recess spaced approximately 0.3 inches from the cover, means for coupling microwave energy from the waveguide through the aperture to the radiating element, means for rotating the radiating element in a plane parallel with the cover, and an electric heating element positioned in the cavity for providing thermal energy for cooking and for self-cleaning.

BRIEF DESCRIPTION OF THE DRAWINGS

The objects and advantages described herein will be more fully understood by reading the Description of the Preferred Embodiment with reference to the drawings wherein.

DESCRIPTION OF THE PREFERRED EMBODIMENT

Figure 1:
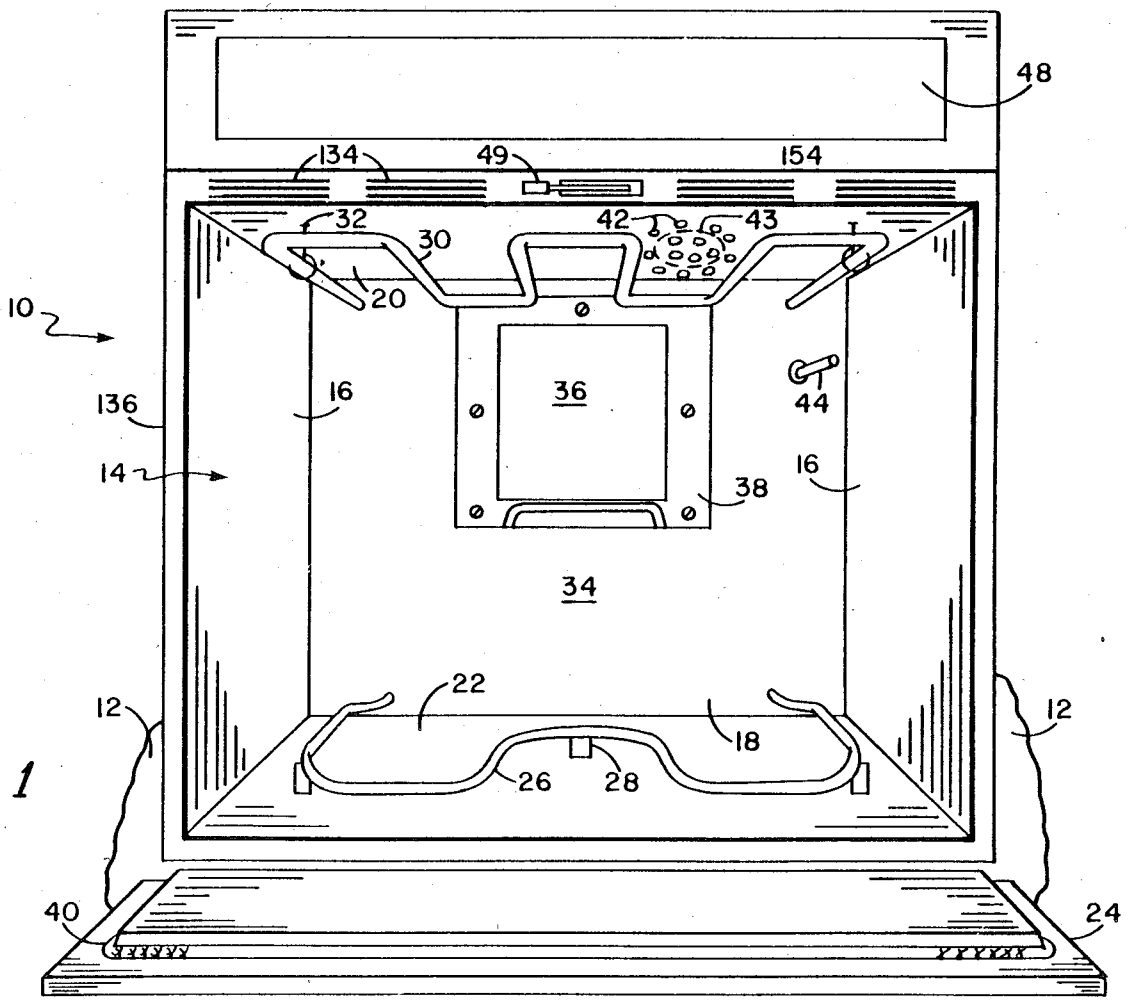
FIG. 1 is a perspective view of a wall oven.

Referring to FIG. 1, there is shown a perspective view of oven 10. Although oven 10 is here shown as a wall oven mounted in wall 12, those skilled in the art will understand that the advantages of the invention can also be practiced in a free standing range. Oven 10 has an oven cavity 14 in which food can be cooked by thermal energy alone, microwave energy alone, or a combination of microwave and thermal energy. Cavity 14 is defined by side walls 16, back wall 18, ceiling 20, floor 22, and door 24. Thermal energy is provided by conventional electric bake heating element 26 here shown supported horizontally adjacent to floor 22 by stands 28. Also, a conventional electric broil heating element 30 is suspended in a horizontal plane adjacent to ceiling 20 by bracket 32. In addition to electric heating elements 26 and/or 30 providing thermal energy for cooking, one or both of them are also used to heat cavity 14 to approximately 900° F. for self-cleaning by pyrolysis. As will be described in detail later herein, microwave energy can be coupled into the cooking region 34 of cavity 14 through microwave transparent cover 36 which is held in place by cover frame 38 on the back wall 18. Door 24 is provided with a choke 40 to prevent microwave energy from escaping cavity 14. Perforations 42 provide for exhaust of air from cavity 14 through smoke eliminator 43 as will be described in detail later herein. Temperature sensor 44 which may define a temperature bulb or thermocouple provides controller 46 (FIG. 8) with an indication of the cavity temperature for thermostatic action. Latch 49 can be used to lock door 24.

Figure 7:
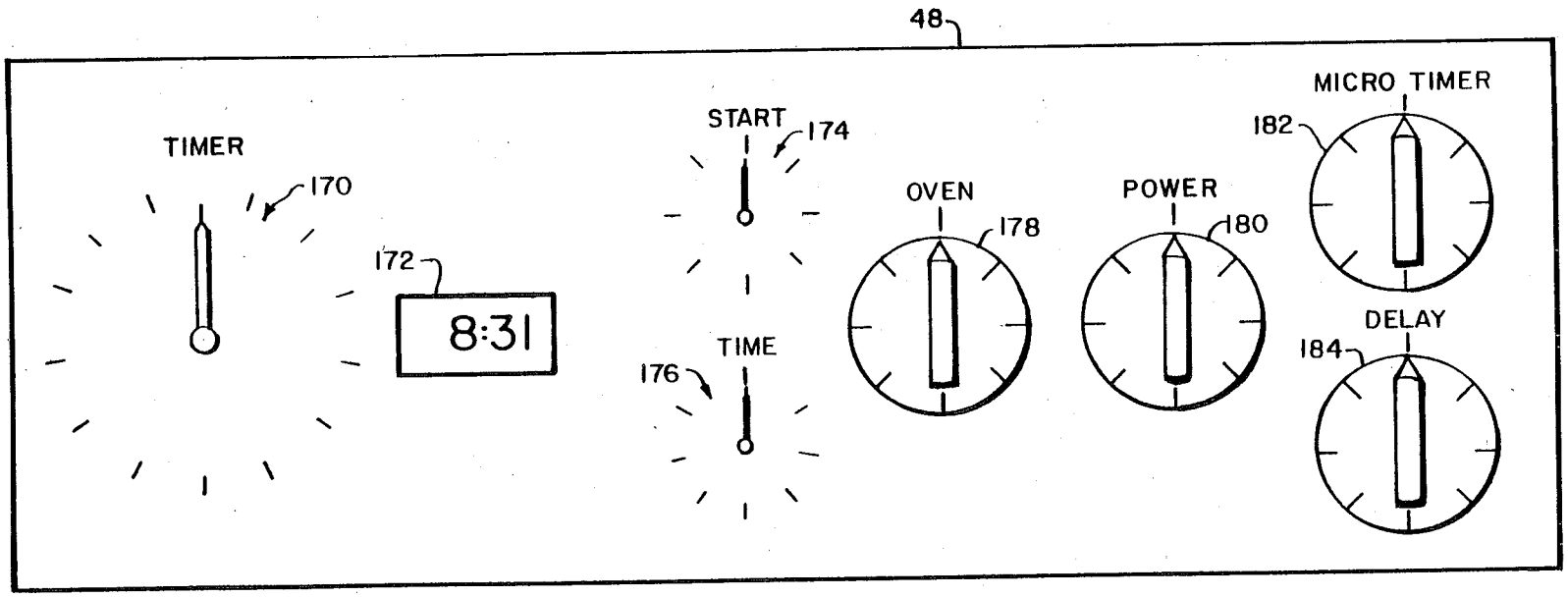
FIG. 7 shows the control panel.

Control panel 48, which will be described in detail later herein with reference to FIG. 7, is coupled to controller 46 and is used to input operator actuated commands.

Figure 2:
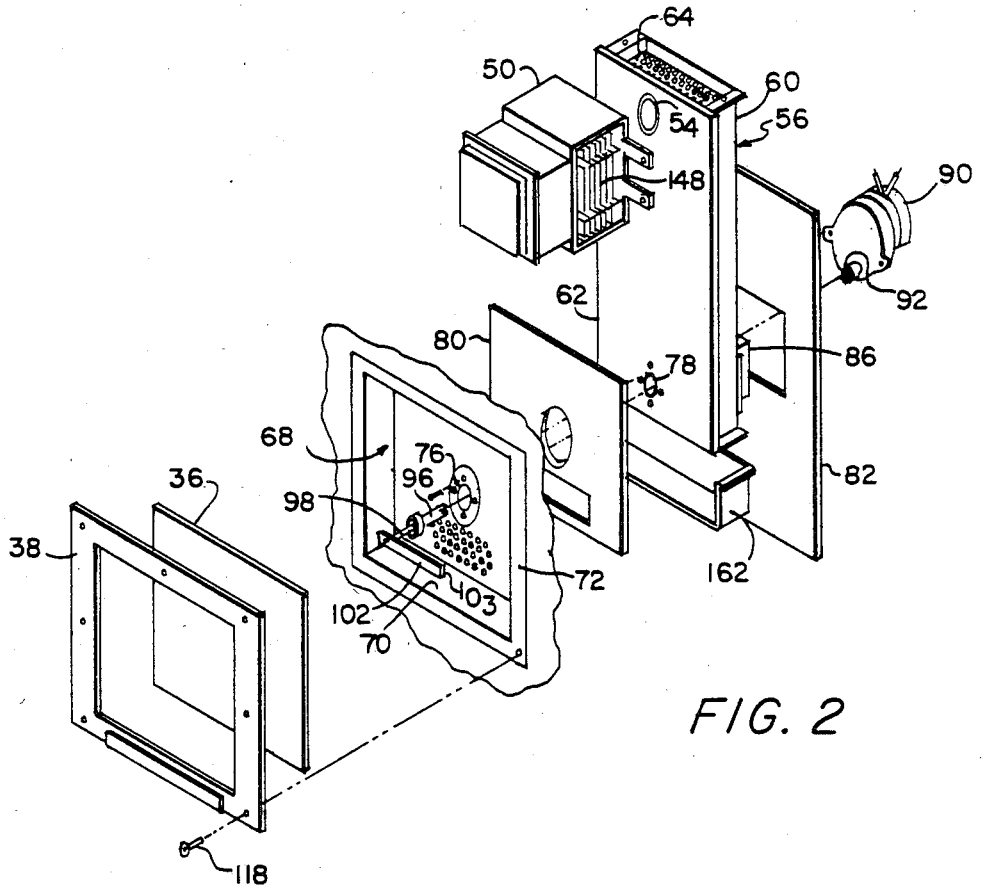
FIG. 2 is an exploded view of apparatus for energizing the oven with microwave energy.
Figure 3:
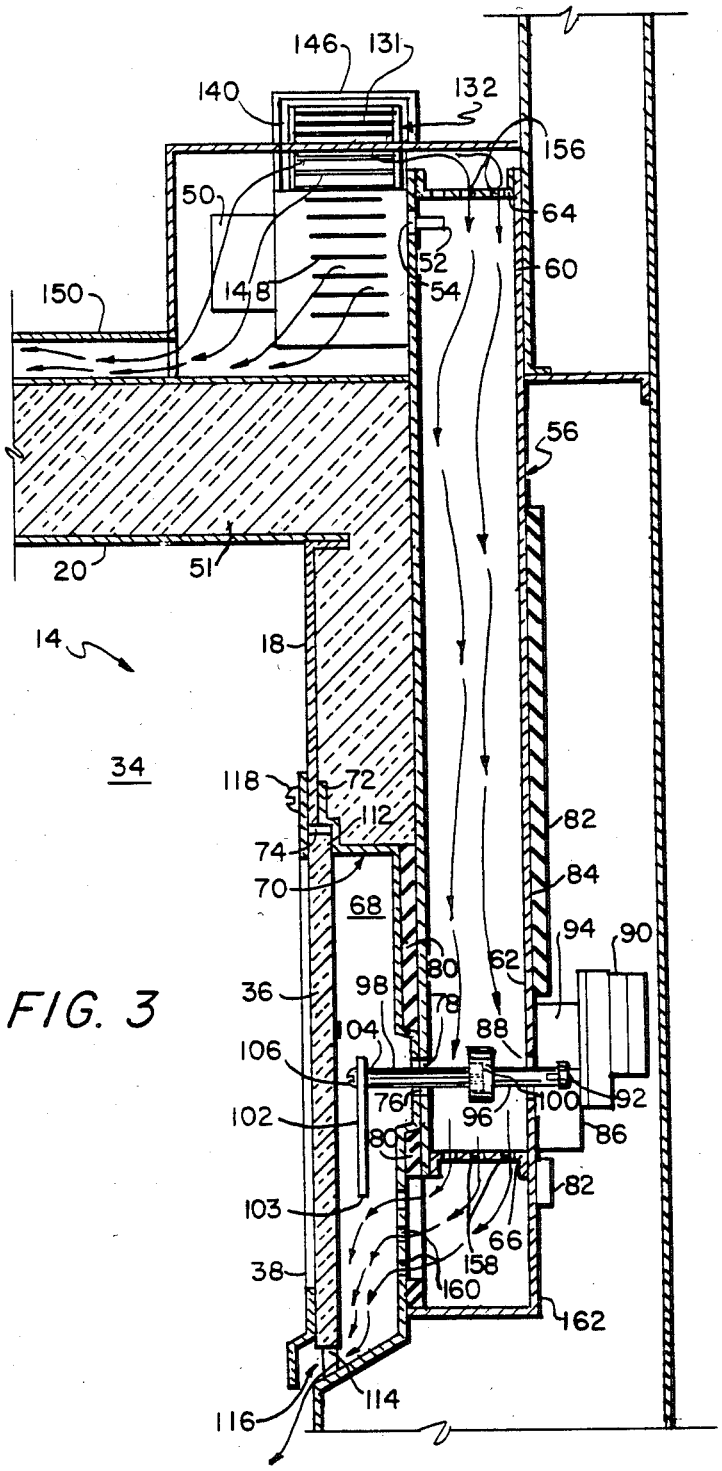
FIG. 3 is a side-sectioned view of the apparatus of FIG. 2 connected to the cavity.

Referring to FIG. 2, there is shown an exploded view of apparatus for exciting cavity 14 with microwave energy. FIG. 3 is a side-sectioned view of the apparatus of FIG. 2 connected to cavity 14. Magnetron 50 is positioned above insulation 51 adjacent cavity ceiling 20 and provides microwave energy having a frequency such as, for example, 2450 MHz. The output probe 52 of magnetron 50 is inserted through circular hole 54 in waveguide 56. In response to power supply 58 (FIG. 6) being activated, output probe 52 excites rectangular waveguide 56 with microwave energy which propagates from the source end 60 to the cavity feed end 62. Waveguide shorts 64 and 66 prevent microwave energy from escaping the ends of waveguide 56. Cavity 14 has a recess 68 in the back wall 18 formed by box 70 which preferably has a flange 72 which is welded around the perimeter of a cutout 74 in the back wall 18 of cavity 14. Also referring to FIGS. 4 and 5, there are shown expanded views of recess 68 with associated microwave feed apparatus partially broken away from the front and from the side, respectively. Box 70 and the cavity feed end 62 of waveguide 56 each have circular apertures 76 and 78, respectively, which align to each other. A thermal gasket 80 may preferably be seated between the corresponding surfaces of box 70 and waveguide 56 as shown. Also, thermal gasket 82 may preferably be secured to the back side 84 of waveguide 56.

A motor mounting bracket 86 is connected to the back side 84 of waveguide 56 and covers a hole 88 in waveguide 56 which aligns with circular apertures 76 and 78. Motor 90 has a shaft 92 which inserts through motor mounting bracket 86 into the space 94 defined between the back side 84 of waveguide 56 and motor mounting bracket 86. Connected to motor shaft 92 is a microwave transparent drive shaft 96 which extends into waveguide 56 through hole 88 and which may preferably be fabricated from a plastic such as Teflon. By being made of a microwave transparent material, drive shaft 96 does not serve as a center conductor for supporting microwave leakage through hole 88. It is preferable that the joint between drive shaft 96 and motor shaft 92 be readily disengageable by pulling drive shaft 96 forward so that disassembly can be executed from the front. Rod 98 is made of a metal such as aluminum and is rigidly connected by suitable means such as screwing drive shaft 96 into a threaded bore of rod 98. Rod 98 projects horizontally through circular apertures 76 and 78 into recess 68. A radiating finger or antenna 102 is connected to the recess end 104 of rod 98 by suitable means such as a bolt 106 which inserts through a hole in antenna 102 and is tightened down into a threaded bore in rod 98.

Still referring to FIGS. 2–5, box 70 has ledge 112 in which recess cover 36 seats. Cover 36 is made of a high temperature microwave transparent material such as Pyroceram so that it will freely pass microwave energy from recess 68 into cooking region 34 and will be resistant to self-cleaning temperatures. Cover 36, as described briefly earlier, is held firmly in place by metal cover frame 38 which defines a square border with a bottom section bent outwardly for reasons to be described subsequently. Frame 38 is secured to back wall 18 by suitable means, here screws 118 around its periphery.

As is well known, two design objectives of any microwave feed system are that it have optimum impedance matching for maximum power transfer and that it radiate energy into the cavity with a power distribution that provides relatively uniform heating of a variety of food types and geometries. In accordance with the description herein, a microwave feed system was built and it exhibited both of these design objectives. In fact, the microwave feed system even provided relatively uniform heating in low profile snacking cakes which was not possible with prior art back fed microwave ovens. All of the reasons for the improvement in heating uniformity may not be fully understood but an explanation including a discussion of the geometry and some of the dimensions of the feed apparatus is offered. First, according to well known principles, waveguide shorts 64 and 66 are precisely spaced from magnetron output probe 52 and rod 98, respectively, so as to provide an optimum coupling of microwave energy into waveguide 56 and into recess 68.

Figure 4:
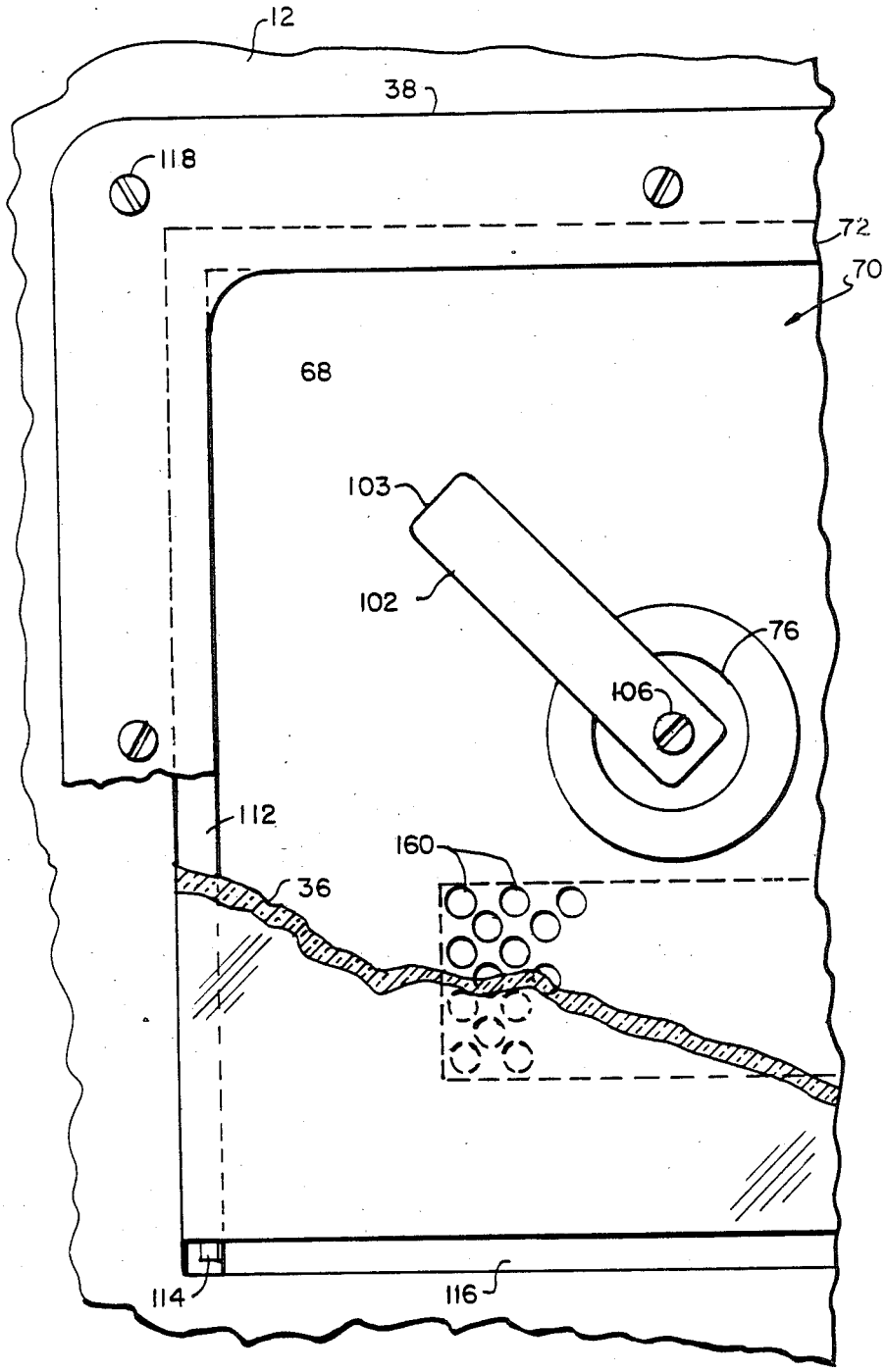
FIG. 4 is an expanded, partially broken away front view of the microwave feed box.
Figure 5:
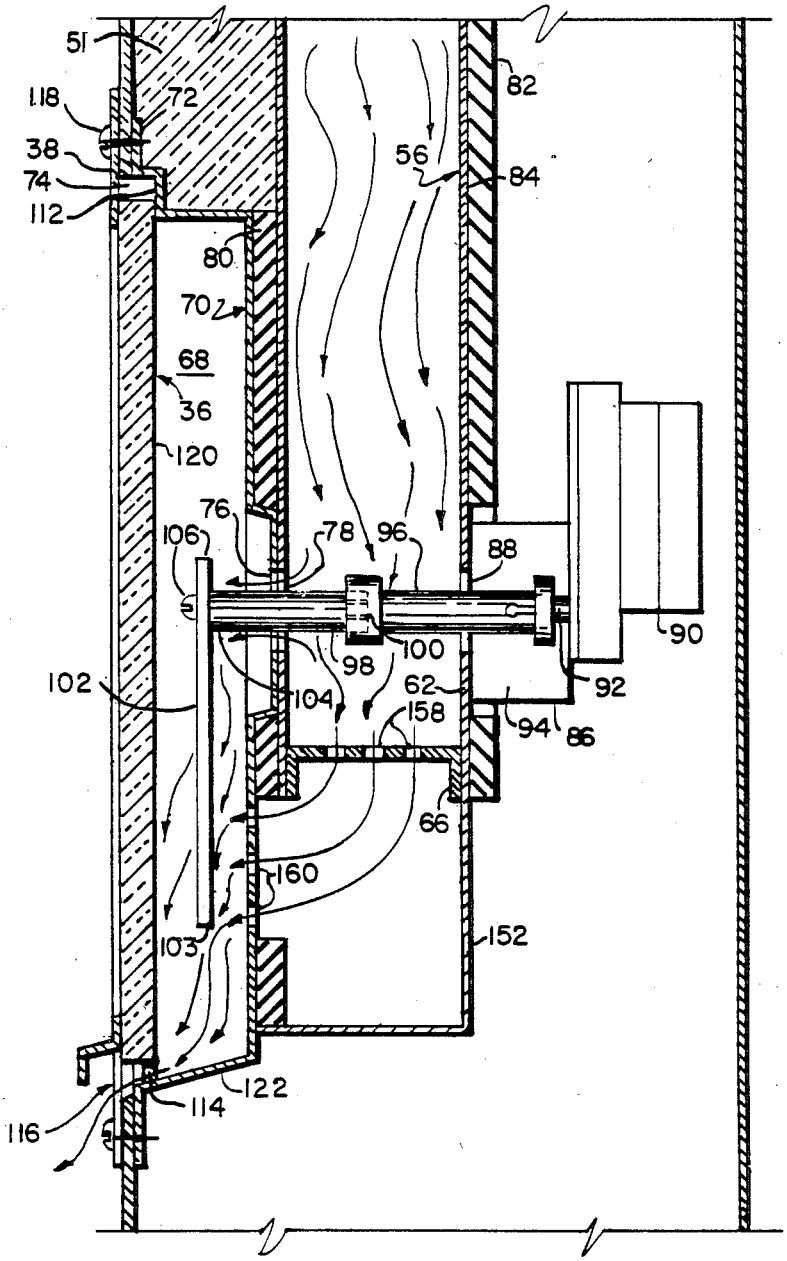
FIG. 5 is an expanded, sectioned side view of the microwave feed box.

Still referring to FIGS. 4 and 5, the entrance to box 70 is close to a square in shape having sides 6 inches by 6.5 inches surrounded by ledge 112 on the top and sides. The depth of box 70 is approximately 0.8 inches from ledge 112 or the rear surface 120 of cover 36. For reasons to be described later herein, the bottom wall 122 of box 70 is sloped downwardly. Pyroceram cover 36 has a thickness of approximately 0.15 inches and is slightly less than 6.5 inches square so that it seats on ledge 112. Radiating antenna 102 has an overall length of approximately 2.45 inches and a radiating length from its connection to rod 98 of approximately 2.2 inches or substantially one-half of a wavelength at 2450 MHz. The width of radiating antenna 102 is slightly larger than one-half inch. Radiating antenna 102, which may preferably be aluminum, is spaced approximately $\frac{3}{8}$ of an inch from cover 36. Rod 98 has a length approximately 1.4 inches and may preferably have a capacitive hat 100. Accordingly, microwave energy couples to rod 98 which functions as a receiving probe antenna and a center conductor to radiating antenna 102. Most of the microwave radiation is from radiating antenna 102 because it is spaced approximately 0.5 inches from the back of box 70 which functions as a ground plane. Because box 70 is rectangular or approximately square, the distance and the coupling between the end 103 of radiating element 102 and the closest adjacent wall of the box varies as radiating antenna 102 rotates. Accordingly, it is believed that the direction of the pattern radiated into cavity 14 varies. It was found that with the particular embodiment described, the dielectric properties of cover 36 and its spaced relationship to radiating antenna 102 were important for impedance matching. For example, as described, the VSWR was 1.7:1 but with cover 36 removed, the VSWR was 5:1. It is also noted that because of the properties of cover 36, the effective electrical distance from the back of box 70 to the front of cover 36 is approximately one quarter of a free space wavelength.

Figure 6:
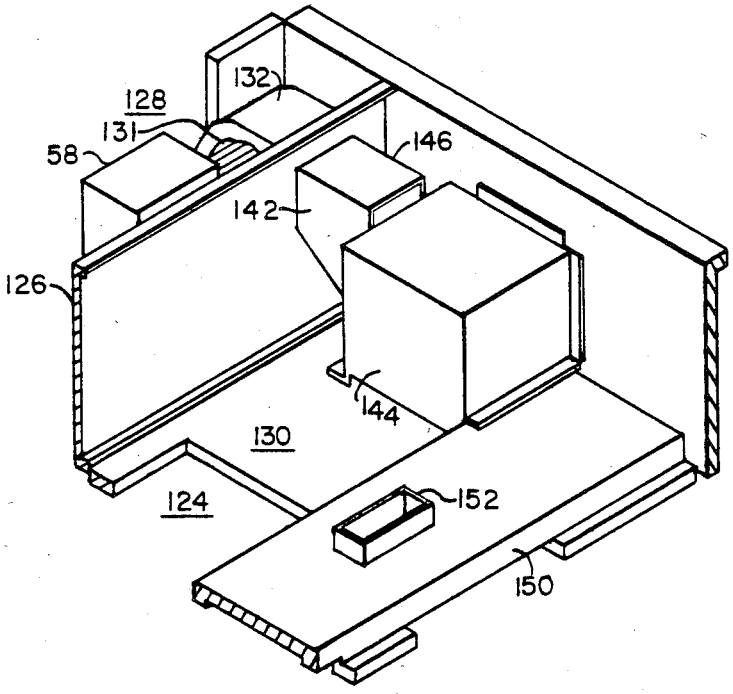
FIG. 6 shows part of the air flow system.

Turning now to the air flow system for oven 10 and referring to FIG. 6, a portion of the back part of control section 124 behind control panel 48 and above ceiling 20 is shown. Partition 126 separates the power supply and blower compartment 128 from the central compartment 130 in which magnetron 50 is positioned. When blower 132 is activated, as will be described in detail later herein, air is drawn into compartment 128 from front intake vent 134 and along side 136. The air passes across power supply 58 which typically consists of a transformer and other components (not shown) to provide cooling. The forced air expelled from blower 132 is directed through an opening 140 in partition 126 into chute 142 which leads to an enclosure 144 surrounding magnetron 50 as shown in FIG. 3. The upper portion 146 of chute 142 may preferably be open directing a portion of the forced air into central compartment 130. A sufficient amount of the forced air that enters magnetron enclosure 144 passes through the fins 148 of magnetron 50 to provide adequate cooling when magnetron 50 is activated. Air exhausts magnetron enclosure 144 through two different paths. The first path flows into flue duct 150 as indicated by the arrows in FIG. 3. The flue duct 150 leads to exhaust vent 154 on the right front of oven 10 above door 24. Duct 152 will be described later herein.

The second air flow path from magnetron enclosure 144 is through perforations 156 in waveguide short 64 into waveguide 56 as shown in FIG. 3. Perforations 156 and all the other air flow perforations are small enough so as to be below microwave cutoff and therefore prevent microwave energy from passing therethrough. The forced air in waveguide 56 passes past magnetron output probe 52 providing some cooling thereof and then out perforations 158 in waveguide short 66. Some of the forced air may also exit waveguide 56 along rod 98 through circular apertures 76 and 78 into recess 68. The air exhausting waveguide 56 through perforations 158 also enters recess 68 as it is directed through duct 162 and perforations 160 which function as an air input port to cavity 14. The forced air passes from recess 68 into the cooking region 34 of cavity 14 via passageway 116 under cover 36. More specifically, the bottom side of box 70 slopes downwardly and has indents or bumps 114 which support cover 36 approximately one quarter inch above the bottom entrance into box 70. Accordingly, an air flow path of approximately one quarter inch by 6 inches is provided from recess 68 into the cooking region 34 of cavity 14. The bottom branch of frame 38 is bent outwardly so as to shield but not impede this described flow of air. Convection air being forced into cavity 14 causes exhaust of air through perforations 42 in the top front of cavity 14. Above perforations 42 is smoke eliminator 43. The air then flows into flue duct 150 to exhaust vent 154. As an alternate embodiment, if the option is available during installation, the exhausting air may bypass duct 150 and flow through duct 152 into an outdoor flue.

Referring to FIG. 7, control panel 48 is shown. Although the controls to be described are shown with mechanical dials, it is understood that controller 46 could be a digital electronic controller or microprocessor in which case, the controls would typically be touch pad switches that are numerically or functionally labeled. TIMER control 170 can be used to set a particular time duration and, after that duration has elapsed, an audible alarm is sounded. CLOCK 172 displays the time of day. START control 174 can be used to commence the selected cooking mode or cleaning at a future time. TIME control 176 can be used to set the duration of the cooking mode or cleaning. Accordingly, using START control 174 and TIME control 176, the operator can set oven 10 to turn on at a preset time and then cook for a specified time duration after which the oven turns off. OVEN control 178 sets the mode of bake heating element 26 and broil heating element 30 to bake, broil, or clean. For example, if OVEN control 178 is set to a particular temperature, bake heating element 26 comes on until cavity 14 reaches that temperature and then bake heating element 26 is cycled on and off in response to cavity temperature sensor 44 to maintain the selected cavity temperature. Broil heating element 30 may also be used in the bake mode of operation; in this case, it may be preferable to activate broil heating element 30 at a reduced voltage such as, for example, 120 volts AC instead of 240 volts AC. In broil mode, only broil heating element 30 is activated. In clean mode, bake heating element 26 and preferably broil heating element 30 are activated. In self-clean, the temperature of cavity 14 is raised to a self-clean temperature such as, for example, 900° F. and then maintained at that temperature for two or three hours to degrade the oven soils by pyrolysis. POWER control 180 is used to set the microwave power level such as in the range from 20% to 100%. MICRO TIMER control 182 is used to set the time duration of microwave exposure. DELAY control 184 can be used to delay the commencement of the activation of magnetron 50 so that, if using combination cooking, the microwave cooking can be delayed into the thermal cooking cycle, if desired.

Figure 8:
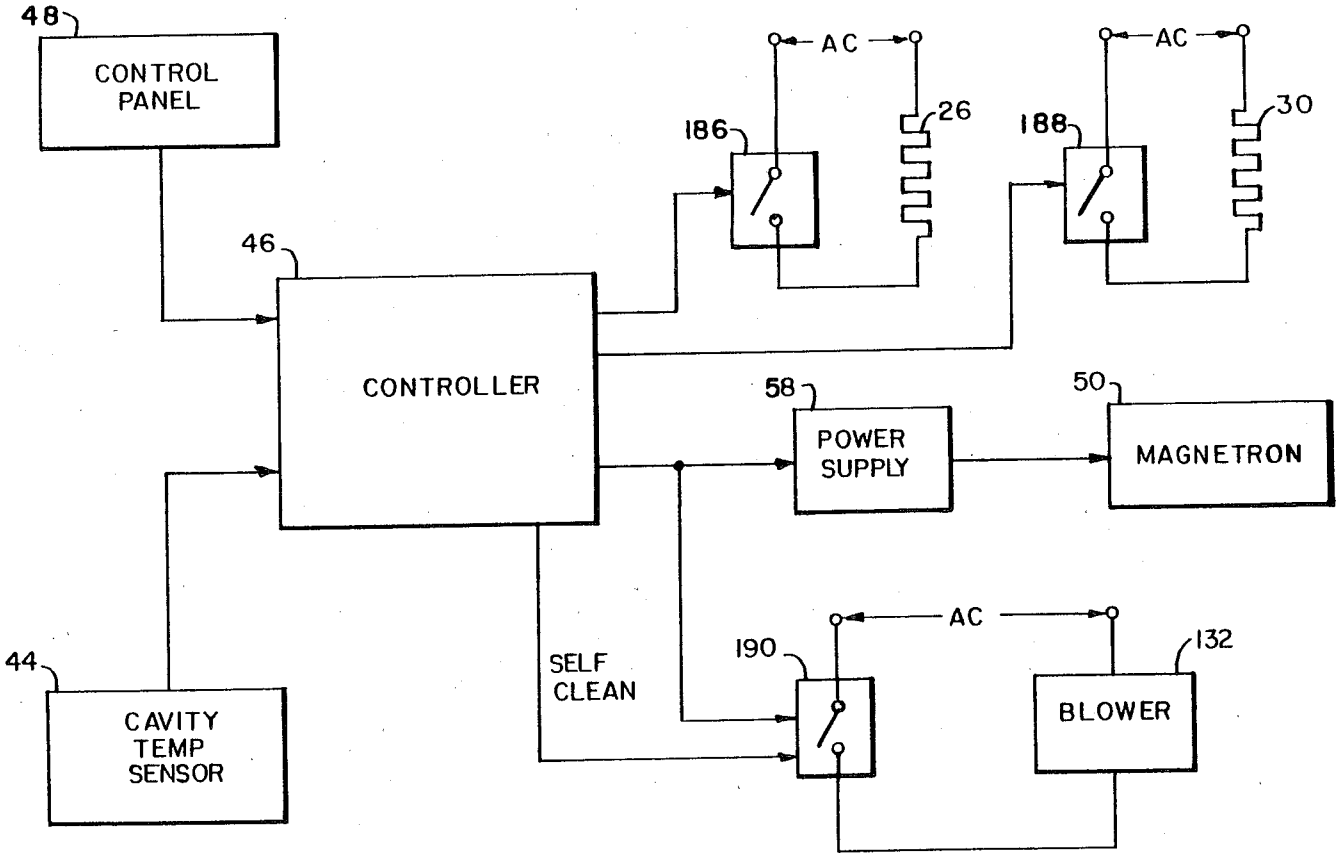
FIG. 8 is a schematic diagram of the control for the oven.

Referring to FIG. 8, a schematic diagram of the control circuit for oven 10 is shown. Control panel 48 and cavity temperature sensor 44 are both shown providing inputs to controller 46. The functions described herein with regard to controller 46 could be provided by a conventional electromechanical oven controller or a digital electronic controller. In response to an operator actuated control or command from control panel 48, controller 46 activates relays 186 and 188 to turn on bake heating element 26 or broil heating element 30, respectively, as appropriate. The AC voltage applied across bake heating element 26 and broil heating element 30 may preferably be either 120 volts or 240 volts as is desirable for the particular operational task. In response to MICRO TIMER control 182, controller 46 turns on magnetron 50 by activating power supply 58. As described, the basic modes of operation are BAKE only which may activate broil heating element 30 in addition to bake heating element 26, BROIL only, MICRO only, COMBINATION using microwave plus thermal, and SELF-CLEAN. Anytime magnetron 50 is turned on, controller 46 closes relay 190 to activate blower 132 which is required to cool magnetron 50. Also, controller 46 closes relay 190 to activate blower 132 in the self-clean mode so as to provide a flow of air from recess 68 into the cooking region 34 of cavity 14 through passageway 116 as described in order to resist the extremely hot self-cleaning air from flowing into waveguide 56 where plastic drive shaft 96 is positioned. If the extremely hot self-cleaning air were permitted to flow up waveguide 56, it could damage other parts and components such as electronics, motor 90, and the impeller 131 of blower 132. In an alternate embodiment, the closing of relay 190 could be controlled by the closing of latch 49 which must be locked to initiate either microwave or self-cleaning operation. Also, the closing of relay 190 for self-clean operation could be initiated by a thermostat set at some temperature such as, for example, 500° F. Further, although blower 132 is shown being activated by microwave operation or self-clean, it may also be preferable that blower 132 be activated for all thermal operation including bake and broil. The capacity of blower 132 and the constrictions of perforations 156, 158, 160 and 42 and the constrictions of passageway 116 and the smoke eliminator 43 should be such that during self-cleaning, air flows down waveguide into cavity 14. For this purpose, 0.5 CFM may be sufficient. However, in order to improve ventilation during microwave operation, it may be preferable that the flow rate be in the range from 1–3 CFM or more preferably, in the range from 1–2 CFM. As an alternate embodiment, the speed of blower 132 could be varied to optimize the air flow rates for different operational modes. If more air were forced into cavity 14 during self-clean, it could make it difficult or inefficient to reach and maintain self-cleaning temperatures. Also, because smoke eliminator 43 at the output of cavity 14 may be the smallest constriction in the overall air flow path, if more air were forced into cavity 14, it could create a positive pressure sufficient to force self-clean decomposition by-products out around door 24. So called "auto-ignition" is a phenomenon that occurs during self-cleaning if, as a result of degradation of soils, a combustible substance is present in the cavity and the temperature and oxygen levels are sufficient to ignite it. Following auto-ignition, there is a brief but dramatic increase in pressure which may, for example, be on the order of ten pounds per square inch above atmospheric. Obviously, the air flow down waveguide 56, as described herein, would be briefly interrupted because the flow would be totally insufficient to prevent degradation products from flowing into waveguide 56. The backward flow, however, has such a short duration that temperature sensitive parts such as drive shaft 96 are not damaged.

This concludes the description of the preferred embodiment. The reading of it by those skilled in the art will bring to mind many alterations and modifications without departing from the spirit and scope of the invention. Accordingly, it is intended that the scope of the invention be limited only by the appended claims.

What is claimed is:

1. A back fed microwave oven, comprising:

a microwave conductive cavity having side walls, a ceiling, a floor, a door, and a back wall with a recess with an aperture;

a microwave transparent cover substantially separating said recess from the remainder of said cavity;

a waveguide positioned behind said back wall and communicating with said recess through said aperture;

a magnetron for energizing said waveguide with microwave energy;

a horizontal rod for coupling microwave energy from said waveguide through said aperture into said recess;

a radiating antenna connected to said rod for radiating microwave energy through said cover into said remainder of said cavity;

means for rotating said rod to rotate said radiating antenna; and said recess having a depth substantially less than a half wavelength of said microwave energy and having side walls configured so that as said radiating antenna rotates, the distance between said antenna and said side walls varies.

2. The oven recited in claim 1 wherein said recess defines a substantially rectangular box.

3. The oven recited in claim 1 further comprising an electric heating element positioned in said remainder of said cavity to provide thermal energy for cooking and self-cleaning.

4. The oven recited in claim 2 wherein said box has a depth of approximately 0.8 inches and said radiating antenna is spaced approximately 0.3 inches from said cover.

5. A back fed common cavity microwave and electric oven, comprising:

a microwave conductive cavity formed by side walls, a ceiling, a floor, a door, and a back wall having a recess defined by an outwardly extending box having a depth substantially less than a half wavelength of the operating frequency of said microwave oven;

a horizontal microwave transparent planar cover substantially separating said recess from the remainder of said cavity;

an electric heating element positioned in said remainder of said cavity for providing thermal energy for cooking and self-cleaning;

a radiating element positioned in said recess substantially parallel with said cover and spaced less than 0.5 inches therefrom;

means for exciting said antenna with microwave energy; and means for rotating said antenna in a vertical plane.

6. The oven recited in claim 5 wherein said antenna is spaced approximately 0.3 inches from said cover.

7. The oven recited in claim 5 wherein said box is approximately 6 inches square and has depth of approximately 0.8 inches.

8. The oven recited in claim 5 wherein said radiating antenna is a flat linear finger approximately half a wavelength of said microwave energy long and rotated about one end.

9. A combination microwave and electric self-cleaning oven comprising:

an oven cavity defined by side walls, a back wall, a floor, a ceiling, and a door;

said back wall having a recess with a substantially rectangular entrance approximately 6 inches square and a depth of less than one inch;

a high temperature resistant microwave transparent flat cover substantially separating said recess from the remainder of said cavity;

a waveguide positioned behind said back wall and communicating with said recess through an aperture in said recess;

a magnetron positioned above said cavity for energizing said waveguide with microwave energy;

a radiating antenna having a length less than 3 inches, said antenna being spaced less than one half inch from said cover in said recess;

means for rotating said antenna in a plane parallel with said cover;

means for coupling microwave energy from said waveguide through said aperture to said radiating antenna; and an electric heating element positioned in said cavity for providing thermal energy for cooking and for self-cleaning.

10. The oven recited in claim 9 wherein the sum of the effective electrical lengths of the depth of said recess and the thickness of said cover is approximately one quarter wavelength of said microwave energy in free space.

11. A combination microwave and electric self-cleaning wall oven comprising:

an oven cavity defined by side walls, a back wall, a floor, a ceiling, and a door;

said back wall having a recess with a substantially rectangular entrance approximately 6 inches square with a depth of less than one inch;

a microwave transparent cover substantially separating said recess from the remainder of said cavity;

a waveguide positioned behind said back wall and having one end communicating with said recess through an aperture, said waveguide extending vertically upward and terminating above said ceiling;

a magnetron positioned above said ceiling and being coupled to said waveguide for providing microwave energy thereto;

a radiating antenna having a length of approximately one half wavelength of said microwave energy being positioned in said recess spaced approximately 0.3 inches from said cover;

means for coupling said microwave energy from said waveguide through said aperture to said radiating antenna;

means for rotating said radiating antenna in a plane parallel with said cover; and an electric heating element positioned in said cavity for providing thermal energy for cooking and for self-cleaning.

* * * * *